US005787549A

United States Patent [19]

Soderlund

[11] Patent Number: 5,787,549

[45] Date of Patent: Aug. 4, 1998

[54] TORSION ROD HINGE WITH FRICTION DAMPENING

[75] Inventor: Jeffrey A. Soderlund, Center City, Minn.

[73] Assignee: Reell Precision Manufacturing Corporation, St. Paul, Minn.

[21] Appl. No.: 858,931

[22] Filed: May 20, 1997

[51] Int. Cl.[6] ..... E05F 1/08

[52] U.S. Cl. ..... 16/308; 49/386; 267/154

[58] Field of Search ..... 16/308, 75, 50, 16/280, 282, 286, 342, 227; 49/381, 386; 267/154, 157

[56] References Cited

U.S. PATENT DOCUMENTS

| | | | |
|---|---|---|---|
| 2,707,799 | 5/1955 | Butterfield | 16/308 |
| 2,916,763 | 12/1959 | Wagner | 16/308 |
| 3,067,453 | 12/1962 | Lyons | 16/308 |
| 3,307,734 | 3/1967 | Campbell | 16/75 |
| 3,498,207 | 3/1970 | Hazen | 16/308 |
| 3,724,134 | 4/1973 | Verdone | 49/379 |
| 4,022,463 | 5/1977 | Scott, Jr. | 272/136 |
| 4,133,074 | 1/1979 | Schack | 16/180 |
| 4,158,271 | 6/1979 | Barry | 49/386 |
| 4,192,099 | 3/1980 | Simko et al. | 49/366 |
| 4,223,483 | 9/1980 | Stafford | 49/386 |
| 4,359,121 | 11/1982 | Messner et al. | 180/69 R |
| 4,377,019 | 3/1983 | Takahashi | 16/307 |
| 4,419,789 | 12/1983 | Matsui et al. | 16/308 |
| 4,423,535 | 1/1984 | Ojima et al. | 16/85 |
| 4,580,315 | 4/1986 | Beckwith | 16/308 |
| 4,685,658 | 8/1987 | Keown | 267/80 |
| 4,768,317 | 9/1988 | Markham | 52/74 |
| 4,785,501 | 11/1988 | Obana | 16/308 |
| 4,888,921 | 12/1989 | Markham | 52/63 |
| 4,908,906 | 3/1990 | Hanna | 16/126 |
| 5,028,025 | 7/1991 | Herron et al. | 248/185 |
| 5,394,650 | 3/1995 | Dean | 49/386 |
| 5,467,504 | 11/1995 | Yang | 16/342 |

FOREIGN PATENT DOCUMENTS

| | | | |
|---|---|---|---|
| 25182 | 2/1991 | Japan | 16/308 |

*Primary Examiner*—Chuck Mah
*Attorney, Agent, or Firm*—Kinney & Lange

[57] ABSTRACT

The present invention is a hinge system for attaching a hinged element to a base forming a hinged unit. The hinge system includes first and second torsion rods fixed to the hinged element and to the base proximate such that the first and second torsion rods are deflected as the hinged element is rotated relative to the base producing first and second torsion forces. The first and second torsion forces prevent the hinged element from twisting as the hinged element is rotated relative to the base. A friction element is connected between the base and the hinged element for offering resistance to the relative rotation of the base and the hinged element.

12 Claims, 8 Drawing Sheets

10
16
22
24
38A
38B
14
38
46
54
48
30
32
42A
42B
42
18

TORSION ROD HINGE WITH FRICTION DAMPENING

BACKGROUND OF THE INVENTION

This invention relates to a hinge system for rotating a hinged element relative to a base. In particular, the invention relates to using dual torsion rods in combination with a frictional element to create desired hinging characteristics over a range of rotation for a hinged element relative to a base.

It is often advantageous to use a hinge device to control the rotation of one body relative to another. Different hinges can be used to produce various desired hinging characteristics. Torsion rods have been used within hinge devices to aid in the hinging one body relative to another. The deflection of a torsion rod can be used to counterbalance the weight of a hinged element to aid in the rotating of the hinged element, providing more desirable performance characteristics. Generally, however, the torsion force produced by the deflection of a torsion rod may be utilized in only a single direction of rotation of a hinged element. Often it would be useful for a hinge device to provide a force in both directions of rotation of a hinged element.

A torsion rod can also produce sufficient torsion force to aid in rotating the hinged element when a hinged element has substantial weight. When the hinged element has substantial size, however, a torsion rod hinge may cause the hinged element to twist or become canted from one side to the other.

The present invention solves these and other problems associated with the prior art systems.

SUMMARY OF THE INVENTION

The present invention is a hinge system for attaching a hinged element to a base forming a hinged unit. The hinge system includes a first torsion rod that has a first end fixed relative to the hinged element proximate a first location on the unit. The first torsion rod also has a second end fixed relative to the base proximate a second location on the unit. The first torsion rod is configured to be deflected as the hinged element is rotated relative to the base producing a first torsion force.

The hinged system includes a second torsion rod that has a first end fixed relative to the base proximate the first location on the unit. The second torsion rod also has a second end fixed relative to the hinged element proximate the second location on the unit. The second torsion rod is configured to be deflected as the hinged element is rotated relative to the base producing a second torsion force.

In the hinged system, the first torsion rod and the second torsion rod are configured such that the first and second torsion forces prevent the hinged element from twisting as the hinged element is rotated relative to the base. A friction element is connected between the base and the hinged element, which offers resistance to the relative rotation of the base and the hinged element.

In one embodiment, the hinged system includes first and second mounting blocks, which are mounted to the hinged element proximate the first and second locations on the unit, respectively. The hinged system also includes third and fourth mounting blocks, which are mounted to the base proximate the first and second locations on the unit, respectively. In this embodiment, the first end of the first torsion rod is fixed to the first mounting block, the second end of the first torsion rod is fixed to the fourth mounting block, the first end of the second torsion rod is fixed to the third mounting block, and the second end of the second torsion rod is fixed to the second mounting block.

In one embodiment of the hinged system, the friction element is a first spring pin frictionally coupled between the first and third mounting blocks and a second spring pin frictionally coupled between the second and fourth mounting blocks. In this embodiment, the first and second torsion rods pass through the spring pins.

In one embodiment of the hinged system, the first, second, third, and fourth mounting blocks defme first, second, third, and fourth bores, respectively. In this embodiment, the first torsion rod passes through the first spring pin, and the first spring pin is frictionally engaged in the first bore and in the third bore. The second torsion rod passes through the second spring pin, and the second spring pin is frictionally engaged in the second bore and in the fourth bore.

DETAILED DESCRIPTION OF THE PREFERRED EMBODIMENTS

Figure 1:
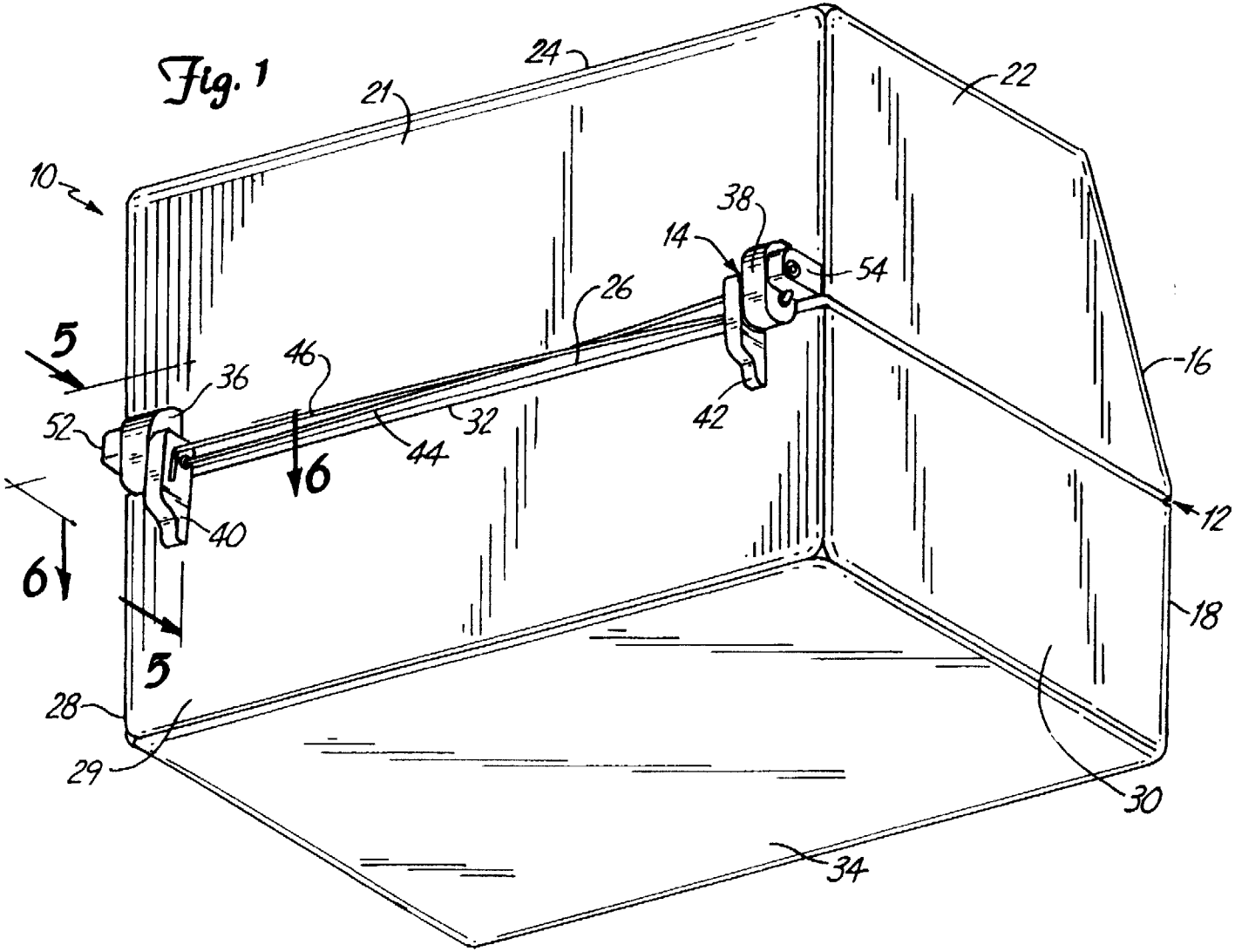
FIG. 1 is a perspective view of a device having a hinge system in accordance with the present invention.
Figure 2:
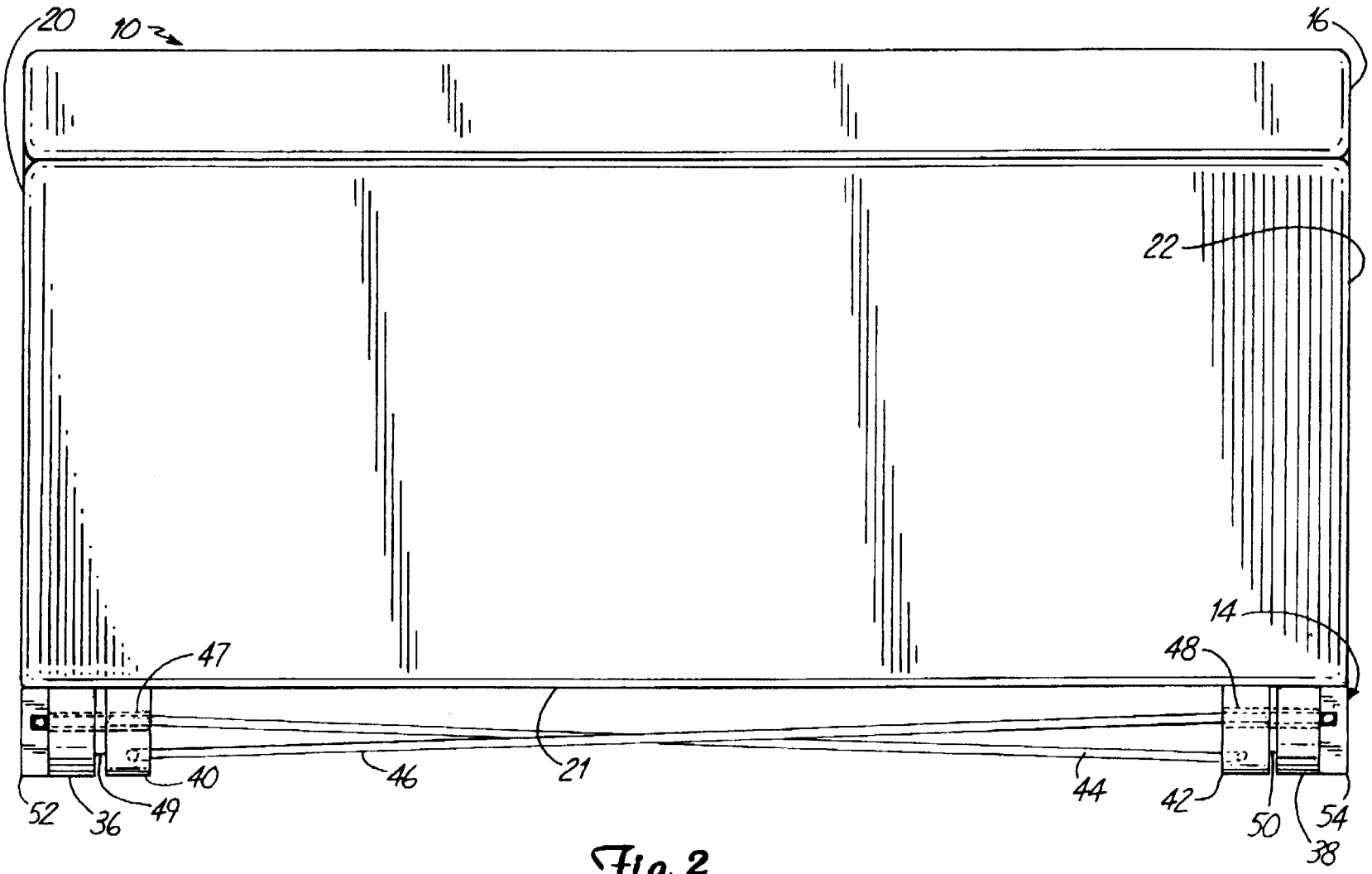
FIG. 2 is a top plan view of the device shown in FIG. 1 having a hinge system in accordance with the present invention.
Figure 3:
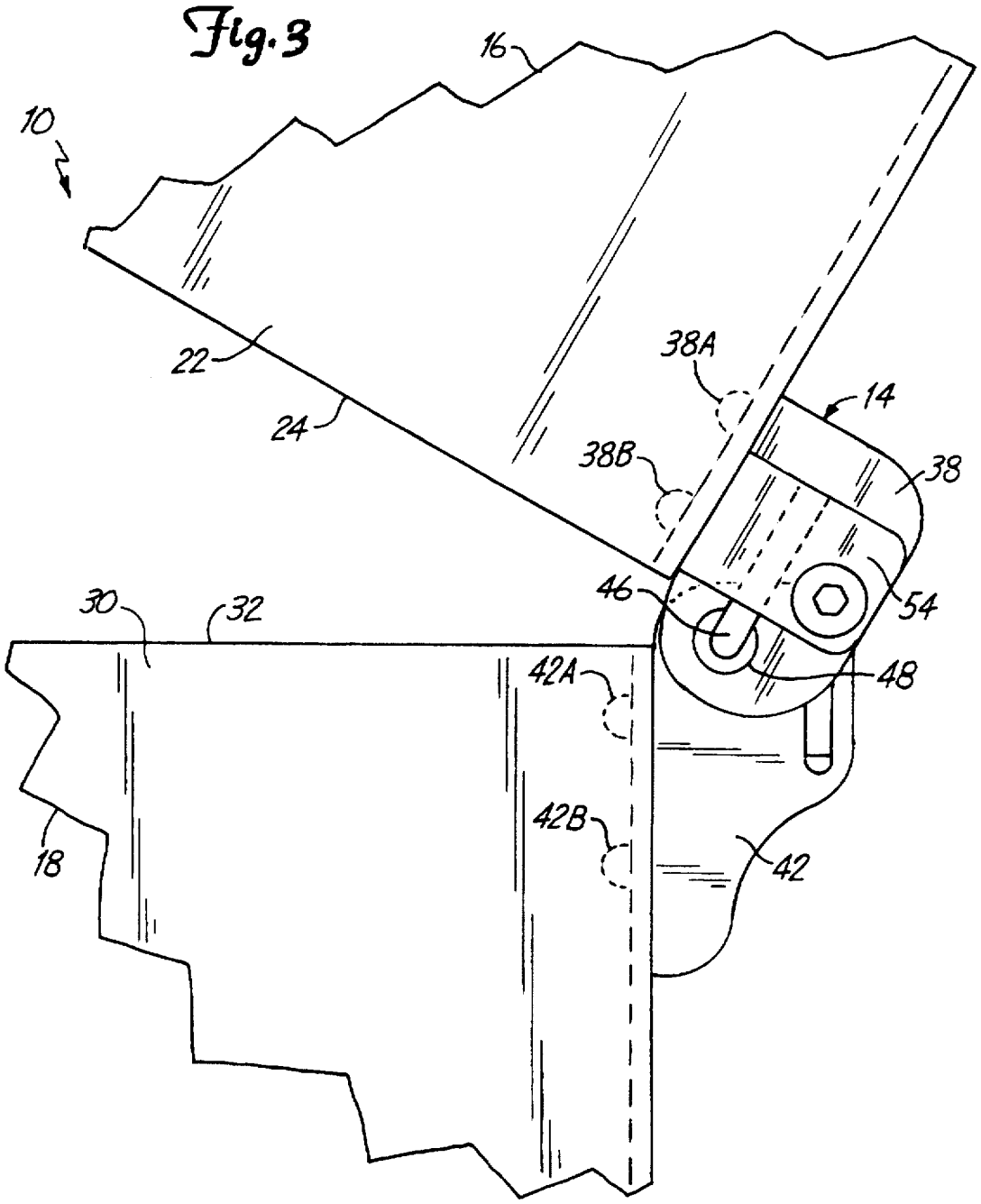
FIG. 3 is a side elevation view of a portion of a device having a hinge system in accordance with invention.

FIGS. 1, 2, and 3 show a preferred embodiment of a hinge system 10 in accordance with the present invention. Hinge system 10 includes hinged structure 12 and hinge assembly 14. Hinged structure 12 includes cover 16 and base 18, which are configured for relative rotation utilizing hinge assembly 14.

Cover 16 of hinged structure 12 has cover first side 20, cover back 21, cover second side 22, cover top 24 and cover bottom 26. Similarly, base 18 of hinged structure 12 has base first side 28, base back 29, base second side 30, base top 32 and base bottom 34.

Hinge assembly 14 includes first and second upper mounts 36 and 38, first and second lower mounts 40 and 42, first and second torsion rods 44 and 46, first and second spring pins 47 and 48 (shown in FIG. 2), first and second spacers 49 and 50 (shown in FIG. 2), and first and second antirotation blocks 52 and 54.

First upper mount 36 is fixed to cover back 21 proximate to first cover side 20 and to cover bottom 26. Second upper mount 38 is fixed to cover back 21 proximate to second cover side 22 and cover bottom 26. First lower mount 40 is fixed to base back 29 proximate to first base side 28 and base top 32. Second lower mount 42 is fixed to base back 29 proximate to second base side 30 and base top 32. Mounts 36, 38, 40 and 42 may be fastened to cover 16 and base 18 by any suitable fastening means. For example, in FIG. 3 threaded fasteners 38A and 38B secure mount 38 to cover 16 and threaded fasteners 42A and 42B secure mount 42 to base 18. Rivets or similar means could also be used to secure the mounts to the base and cover. Also, the mounts may be integrally formed as part of the cover and base.

First spring pin 47 is secured within first upper mount 36 and first lower mount 40. Second spring pin 48 is secured within second lower mount 42 and second upper mount 38. First torsion rod 44 is secured to first upper mount 36 by first antirotation block 52, and is also secured to second lower mount 42. Second torsion rod 46 is secured to first lower mount 40, and is also secured to second upper mount 38 by second antirotation block 54. First spacer 49 spaces first upper mount 36 from first lower mount 40. Second spacer 50 spaces second upper mount 38 from second lower mount 42. Spacers 49 and 50 prevent mounts 36, 38, 40, and 42 from wearing against each other during the relative rotation of cover 16 to base 18.

In operation of hinge system 10, cover 16 is mounted for relative rotation with base 18 through hinge assembly 14. Cover 16 is connected with base 18 by fixing first and second upper mounts 36 and 38 to cover back 21, by coupling first and second upper mounts 36 and 38 to first and second lower mounts 40 and 42 using first and second spring pins 47 and 48, and by fixing first and second lower mounts 40 and 42 to base back 29.

First torsion rod 44 is fixed to cover 16 through first upper mount 36 and first antirotation block 52, and fixed to base 18 through second lower mount 42. Similarly, second torsion rod 46 is fixed to cover 16 through second upper mount 38 and second antirotation block 54, and fixed to base 18 through first lower mount 40. Consequently, torsion rods 44 and 46 are deflected as cover 16 is rotated relative to base 18 creating a torsion force. Spring pin 47 is coupled within first upper mount 36 and first lower mount 40 and spring pin 48 is coupled within second lower mount 42 and second upper mount 38. Spring pins 47 and 48 are axially aligned so that cover 16 rotates relative to base 18 about the common axis of pins 47 and 48. As cover 16 is rotated relative to base 18, spring pins 47 and 48 cause resistance to the relative rotation. The combination of the resistance caused by spring pins 47 and 48 with the torsion force from torsion rods 44 and 46 create desired performance characteristics over a range of rotation for cover 16 relative to base 18.

Figure 4A:
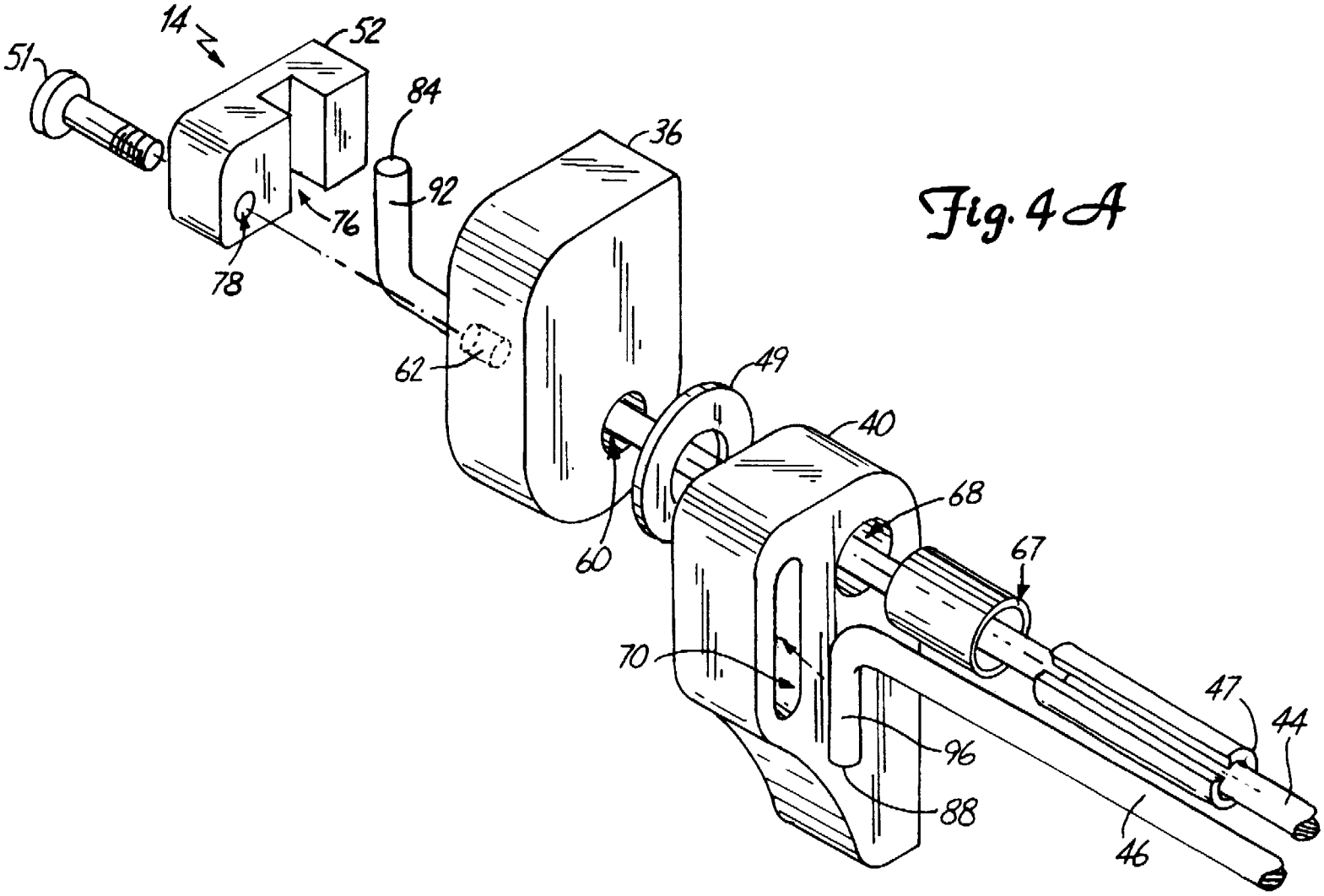
FIGS. 4A and 4B are exploded views of a hinge assembly in accordance with th present invention.
Figure 4B:
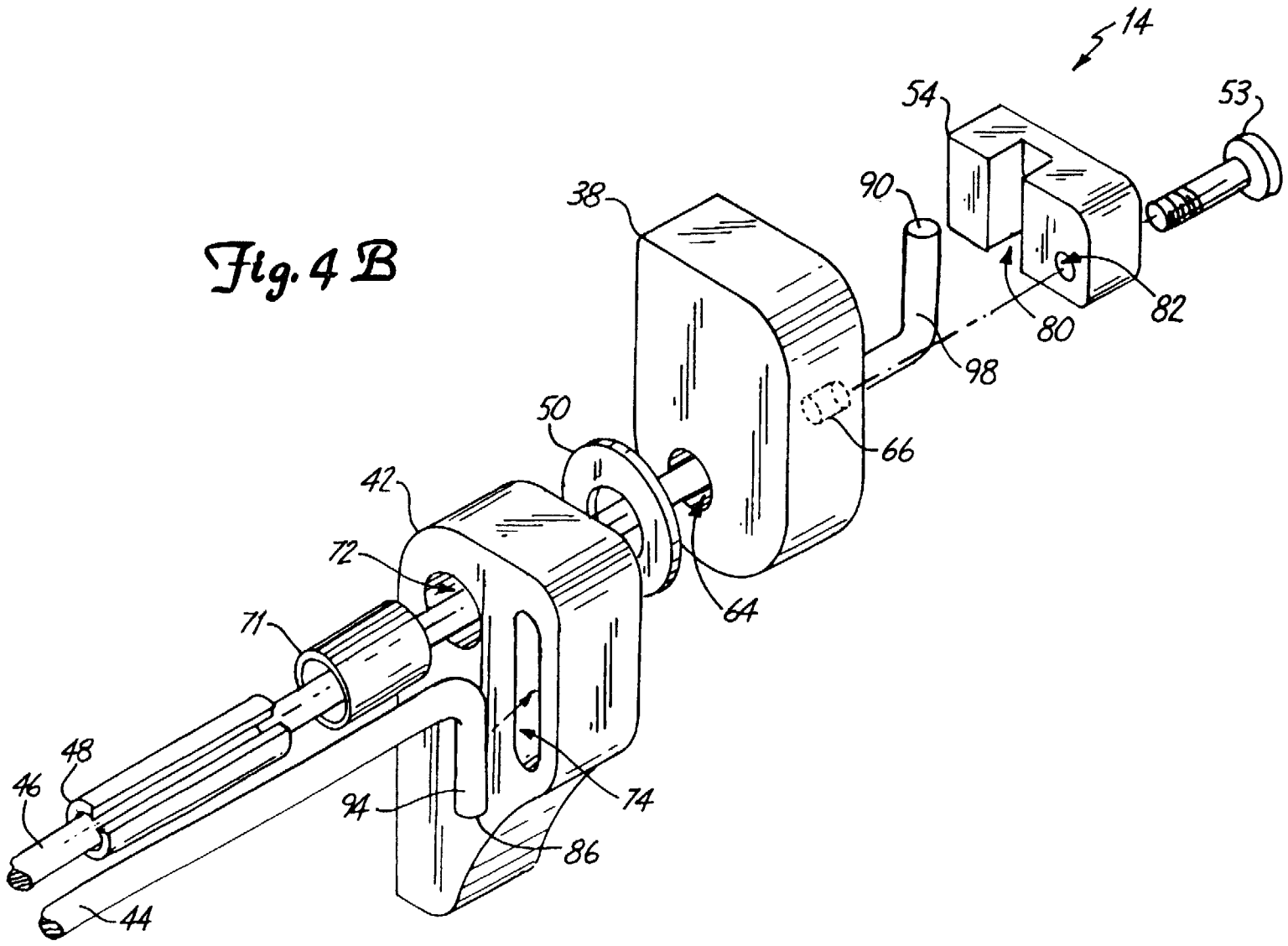

FIGS. 4A and 4B show exploded views of hinge assembly 14 in greater detail. First upper mount 36 includes first upper mount bore 60 and first upper mount threaded aperture 62. Second upper mount 38 includes second upper mount bore 64 and second upper mount threaded aperture 66. First lower mount 40 includes first lower mount bore 68 and first lower mount slot 70. Second lower mount 42 includes second lower mount bore 72 and second lower mount slot 74. First antirotation block 52 includes first block slot 76 and first block aperture 78. Second antirotation block 54 includes second block slot 80 and second block aperture 82. First torsion rod 44 includes first rod upper end 84 and first rod lower end 86. Second torsion rod 46 includes second rod lower end 88 and second rod upper end 90.

First torsion rod 44 extends through spring pin 47, which in turn extends through bushing 67 in bore 68 in mount 40, and through bore 60 in mount 36. The diameter of rod 44 is less than the diameter of spring pin 47 and less than the diameter of first bore 60 such that there is no interference between rod 44 and spring pin 47 or between rod 44 and mount 36. First torsion rod 44 is bent at a near ninety (90) degree angle proximate to end 84 to define upper bent portion 92. First torsion rod 44 extends through first upper mount 36 and bent portion 92 extends along the length of first block slot 76 in antirotation block 52. First threaded fastener 51 extends through block aperture 78 and into first mount threaded aperture 62 in order to secure first antirotation block 52 to first upper mount 36. First antirotation block 52 is fixed to the surface of first upper mount 36 such that bent portion 92 is positioned in slot 76. In this way, bent portion 92 is fixed relative to first upper mount 36 and to first antirotation block 52.

First torsion rod 44 is also bent at a near ninety (90) degree angle proximate to lower end 86 to define lower bent portion 94. Bent portion 94 is positioned in slot 74 of second lower mount 42. In this way, bent portion 94 is fixed relative to second lower mount 42. In FIGS. 4A and 4B bent portions 92 and 94 are in approximately the same plane.

First spring pin 47 is a rigid material and has a slit extending its entire length. When hinge assembly 14 is properly assembled, first spring pin 47 is disposed in bore 60 of first upper mount 36 and in bushing 67, which in turn is in bore 68 of first lower mount 40. The external diameter of pin 47 is slightly greater than the diameter of bore 60 such that there is an interference fit between pin 47 and first upper mount 36. First bushing 67 is disposed between spring pin 47 and first lower mount 40 in bore 68. First bushing 67 has an external diameter slightly greater that the diameter of bore 68 such that when first bushing 67 is disposed in bore 68 it is frictionally locked therein. The external diameter of pin 47 is slightly greater than the internal diameter of first bushing 67 such that there is an interference fit between pin 47 and bushing 67.

Second torsion rod 46 extends through second spring pin 48, which in turn extends through bushing 71 in bore 72 in mount 42, and through bore 64 in mount 38. The diameter of rod 46 is less than the diameter of spring pin 48 and less than the diameter of second bore 64 such that there is no interference between rod 46 and spring pin 48 or between rod 46 and mount 38. Second torsion rod 46 is bent at a near ninety (90) degree angle proximate to end 90 to define upper bent portion 98. Second torsion rod 46 extends through second upper mount 38 and bent portion 98 extends along the length of second block slot 80 in antirotation 54. Second threaded fastener 53 extends through block aperture 82 and into second mount threaded aperture 66 in order to secure second antirotation block 54 to second upper mount 38. Second antirotation block 54 is fixed to the surface of second upper mount 38 such that bent portion 98 is positioned in slot 80. In this way, bent portion 98 is fixed relative to second upper mount 38 and to second antirotation block 54.

Second torsion rod 46 is also bent at a near ninety (90) degree angle proximate to end 88 to define lower bent portion 96. Bent portion 96 is positioned in slot 70 of first lower mount 40. In this way, bent portion 96 is fixed relative to first lower mount 40. In FIGS. 4A and 4B bent portions 96 and 98 are in approximately the same plane.

Second spring pin 48 is a rigid material and has a slit extending its entire length. When hinge assembly 14 is properly assembled, second spring pin 48 is disposed in bore 64 of second upper mount 38 and in bushing 71, which in turn is in bore 72 of second lower mount 42. The external diameter of pin 48 is slightly greater than the diameter of bore 64 such that there is an interference fit between pin 48 and second upper mount 38. Second bushing 71 is disposed between spring pin 48 and second lower mount 42 in bore 72. Second bushing 71 has an external diameter slightly greater that the diameter of bore 72 such that when second bushing 71 is disposed in bore 72 and is frictionally locked therein. The external diameter of pin 48 is slightly greater than the internal diameter of second bushing 71 such that there is an interference fit between pin 48 and bushing 71.

In operation of hinge system 10, cover 16 and base 18 are configured for relative rotation using hinge assembly 14. As is best seen in FIG. 3, cover 16 may be rotated to various angles relative to base 18. In FIG. 3, cover bottom 26 is rotated approximately forty-five (45) degrees relative to base top 32. In a preferred embodiment of hinge system 10, cover bottom 26 may be rotated from zero (0) to ninety (90) degrees relative to base top 32. Other configurations will allow other ranges, such as from zero (0) to one hundred and eighty (180) degrees. Over the given range of relative rotation, hinge assembly 14 produces desired control for the rotation of cover 16 relative to base 18.

In a preferred embodiment of hinge system 10, first and second torsion rods 44 and 46 are in free positions when cover bottom 26 is rotated ninety (90) degrees relative to base top 32, that is, cover bottom 26 and base top 32 are separated by a ninety 90 degree angle (open position). First torsion rod 44 is in free position when bent portion 92 is not deflected relative to bent portion 94 such that portions 92 and 94 are in approximately the same plane (as seen in FIGS. 4A and 4B). Similarly, second torsion rod 46 is in free position when bent portion 96 is not deflected relative to bent portion 98 such that portions 96 and 98 are in approximately the same plane. In these free positions, rods 44 and 46 are not deflected or stressed, and thus are not producing torsional forces.

As cover 16 is rotated from the open position toward base 18, first and second upper mounts 36 and 38 are rotated relative to first and second lower mounts 40 and 42. Since bent portions 92 and 98 are fixed to first and second upper mounts 36 and 38, they will also be rotated with cover 16. Bent portions 94 and 96, however, are fixed to first and second lower mounts 40 and 42, and thus to base 18, and will be held stable relative to bent portions 92 and 98. In this way, torsion rods 44 and 46 are no longer in their free positions and are deflected as cover 16 is rotated from ninety (90) degrees relative to base 18 to smaller angles. Consequently, first torsion rod 44 resists the closing of cover 16 with a first torsion force and second torsion rod 46 resists the closing of cover 16 with a second torsion force.

Also in a preferred embodiment of hinge system 10, first spring pin 47 will be held stable and will not rotate relative to first upper mount 36 as cover 16 is rotated relative to base 18 (and thus as mount 36 is rotated relative to mount 40). Spring pin 47 is in an interference fit with first upper mount 36 in bore 60, due to their relative diameters, such that spring pin 47 will not rotate relative to first upper mount 36. Spring pin 47 will, however, rotate relative to first bushing 67 as cover 16 is rotated relative to base 18.

The interference between spring pin 47 and first bushing 67 is less than the interference between spring pin 47 and first upper mount 36. In this way, the interference between spring pin 47 and first upper mount 36 will not allow relative rotation between them as cover 16 is rotated relative to base 18. On the other hand, the interference between spring pin 47 and first bushing 67 will allow relative rotation between them as cover 16 is rotated relative to base 18. The interference between spring pin 47 and first bushing 67, however, introduces a first frictional resistive force to the relative rotation of cover 16 to base 18. This first friction force is approximately the same for both directions of rotation of cover 16 to base 18.

Similarly to first spring pin 47, second spring pin 48 will be held stable and will not rotate relative to second first upper mount 38 as cover 16 is rotated relative to base 18. Spring pin 48 is in an interference fit with second upper mount 38 in bore 64, due to their relative diameters, such that spring pin 48 will not rotate relative to second upper mount 38. Spring pin 48 will, however, rotate relative to second bushing 71.

The interference between spring pin 48 and second bushing 71 is less than the interference between spring pin 48 and second upper mount 38. In this way, the interference between spring pin 48 and second upper mount 38 will not allow relative rotation between them as cover 16 is rotated relative to base 18. On the other hand, the interference between spring pin 48 and second bushing 71 will allow relative rotation between them as cover 16 is rotated relative to base 18. The interference between spring pin 48 and second bushing 71, however, introduces a second frictional resistive force to the relative rotation of cover 16 to base 18. This second friction force is approximately the same for both directions of rotation of cover 16 to base 18.

Cover 16 can be opened relative to base 18 such that the first and second torsion forces counteract the weight of cover 16 to assist in the opening of cover 16. Closing cover 16 relative to base 18 is opposed by the first and second torsion forces as well as by the first and second friction forces. In this way, hinge assembly 14 holds cover 16 steady in any of the various angular positions relative to base 18 as the weight of cover 16 is counterbalanced by the combination of the first and second torsion forces and the first and second friction forces.

It should be recognized that other configurations of hinge system 10 may be utilized to perform the present invention. For example, with respect to the first friction force, the interference between spring pin 47 and first bushing 67 may be greater than the interference between spring pin 47 and first upper mount 36. In this way, the interference between spring pin 47 and first bushing 67 will not allow relative rotation between them as cover 16 is rotated relative to base 18. On the other hand, the interference between spring pin 47 and first upper mount 36 will allow relative rotation between them as cover 16 is rotated relative to base 18.

Greater interference between spring pin 47 and first bushing 67 compared to the interference between spring pin 47 and first upper mount 36 can be accomplished by orienting spring pin such that it is positioned further within bushing 67 than in mount 36. Consequently, more surface contact with bushing 67 will create more resistance to rotation. Of course, greater interference can also be accomplished by varying the diameters of bore 60, bushing 67 and even spring pin 47, which could even have multiple diameters.

The interference between spring pin 47 and first bushing 67 may also be the same as the interference between spring pin 47 and first upper mount 36 such that there is relative rotation between both pairs as cover 16 is rotated relative to base 18. In any case, a friction force is introduced to hinge assembly 14 that resists the relative rotation of cover 16 to base 18. The same alternative configurations may apply to the second friction force as well.

Finally with respect to spring pins 47 and 48, bushings 67 and 71 may be removed such that spring pins 47 and 48 are frictionally engaged directly with mounts 40 and 42, respectively. Using bushings 67 and 71 may have the advantage of providing materials that comprise an ideal wear pair. In the alternative embodiment excluding the bushings, the diameter of bore 68 would be slightly less than the outer diameter of spring pin 47, such that pin 47 would be in an interference fit with mount 40. Consequently, as cover 16 is rotated relative to base 18 (and thus as mount 36 is rotated relative to mount 40) spring pin 47 will be held steady within bore 60 of mount 36 (assuming greater interference between pin 47 and mount 36 than between pin 47 and mount 40), and will rotate relative to mount 40 within bore 68. The rotation of pin 47 within bore 68 will create a friction force opposing the relative rotation of cover 16 to base 18. The same alternative configuration also apply to spring pin 48 and bushing 71.

Figure 5:
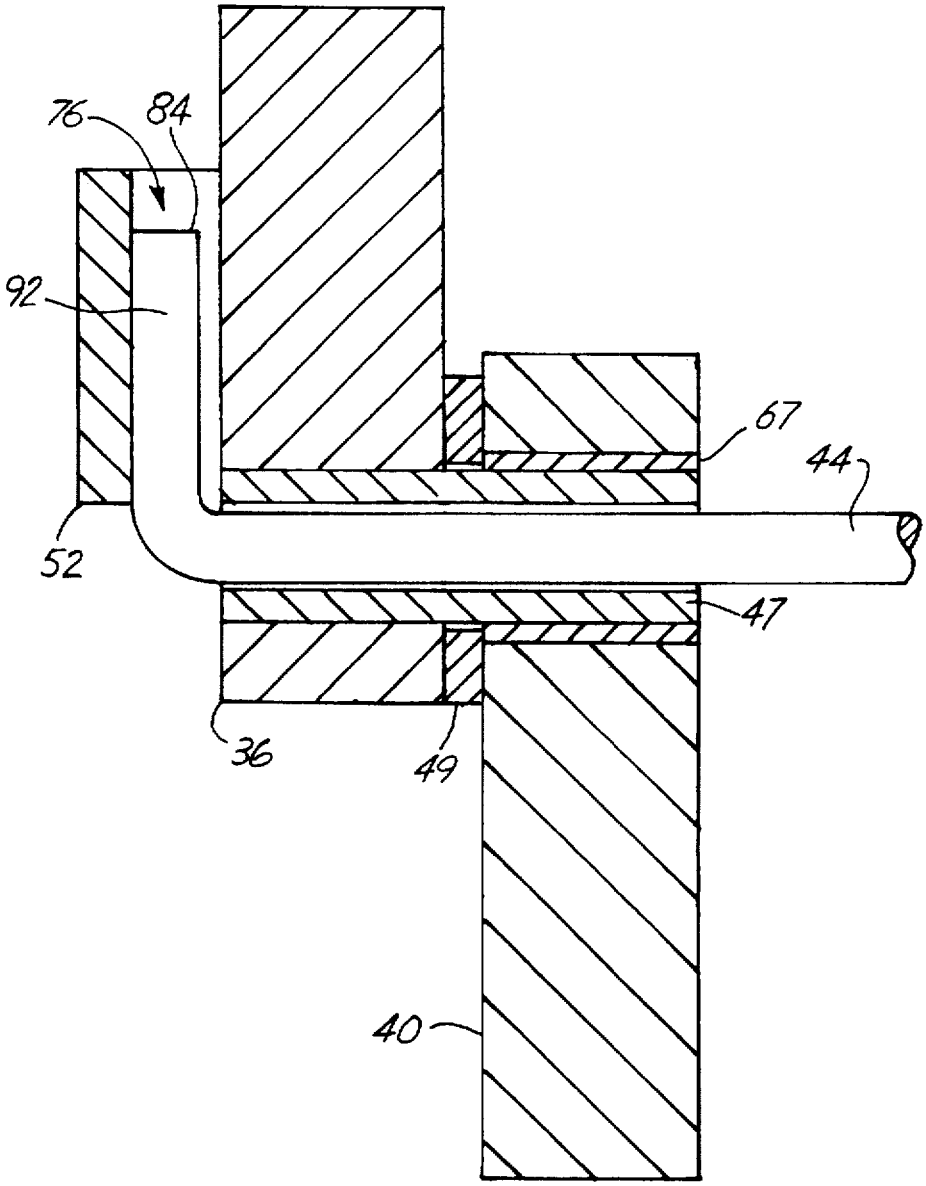
FIG. 5 is a sectional view of the hinge assembly taken at line 5—5 in FIG. 1.
Figure 6:
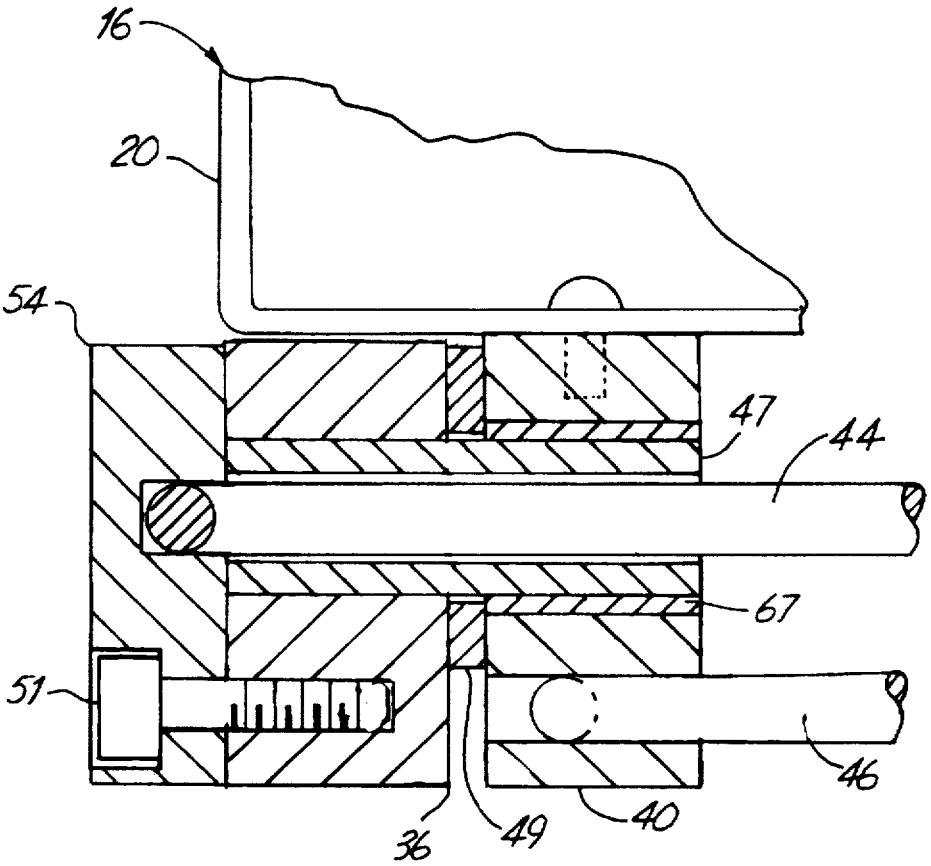
FIG. 6 is a sectional view of the hinge assembly taken at line 6—6 in FIG. 1.

FIGS. 5 and 6 show cross-sectional views of a properly assembled hinge assembly 14 from lines 5—5 and 6—6, respectively, in FIG. 1. First bushing 67 is inserted in mount 40 and is frictionally locked therein. First spring pin 47 extends through bushing 67 (and through mount 40) and through mount 36. First torsion rod 44 extends through first spring pin 47. The diameter of rod 44 is less than the inner diameter of spring pin 47 such that there is no interference between rod 44 and spring pin 47. First torsion rod 44 is bent at a near ninety (90) degree angle proximate to end 84 to define upper bent portion 92. First torsion rod 44 extends through first upper mount 36 and bent portion 92 extends along the surface of first upper mount 36. First antirotation block 52 is fixed to the surface of first upper mount 36 such that bent portion 92 is positioned in slot 76. In this way, bent portion 92 is fixed relative to first upper mount 36 and to first antirotation block 52.

The first and second torsional forces and first and second friction forces produced by hinge assembly 14 create important performance characteristics for hinge system 10. In a preferred embodiment, hinge system 10 is a barbecue grill with cover 16 that opens relative to base 18. Cover 16 can be opened relative to base 18 such that the first and second torsion forces counteract the weight of cover 16 to assist in the opening of cover 16. Closing cover 16 relative to base 18 is opposed by the first and second torsion forces as well as by the first and second friction forces. In this way, hinge assembly 14 holds cover 16 steady in any of the various angular positions relative to base 18 as the weight of cover 16 is counterbalanced by the combination of the first and second torsion forces and the first and second friction forces.

In addition, the first torsion force and the resistance to rotation due to first spring pin 47 both support cover 16 proximate to first side 20. Similarly, the second torsion force and the resistance to rotation due to second spring pin 48 both support cover 16 proximate to second side 22. In this way, the weight of cover 16 is counterbalanced by the distributed torsion and anti-rotation forces in such a way that cover 16 does not twist. If only a single torsion rod were used, cover 16 would tend to twist. The weight of cover 16 due to gravity would be counterbalanced by the torsion rod on the side that is fixed to the torsion rod. The weight of cover 16 due to gravity would not be counterbalanced, however, on the side of the cover 16 that is not fixed to the torsion rod. Consequently, cover 16 would tend to twist where only a single torsion rod is used.

Alternative embodiments of hinge system 10 can accommodate various hinged structures 12. For example, cover 16 may have an unequal weight distribution, wherein cover side 20 is much heavier than second cover side 22. Hinge assembly 14 can accommodate such a configuration with certain variations to first and second torsion rods 44 and 46.

In one embodiment, first torsion rod 44 will have a greater diameter than second torsion rod 46. Thus, the first torsion force caused by the deflection of first torsion rod 44 as cover 16 is moved toward base 18 will be larger than the second torsion force caused by the deflection of second torsion rod 46. This will be true since it takes more force to deflect a rod that is thicker than it takes to deflect a thinner rod. In this way, first the torsion force will support the greater weight of first cover side 20 while the second torsion force will support the lesser weight of second cover side 22. Consequently, first and second cover sides 20 and 22 will be equally supported by hinge assembly 14 and therefore cover 16 will not tend to twist.

In an alternative embodiment, first torsion rod 44 be made of a different material than the material of second torsion rod 46. The material of torsion rod 44 will be more difficult to deflect than second torsion rod 46. Thus, the first torsion force caused by the deflection of first torsion rod 44 as cover 16 is moved toward base 18 will be larger than the second torsion force caused by the deflection of second torsion rod 46. In this way, first the torsion force will support the greater weight of first cover side 20 while the second torsion force will support the lesser weight of second cover side 22. Consequently, first and second cover sides 20 and 22 will be equally supported by hinge assembly 14 and therefore cover 16 will not tend to twist.

In an another alternative embodiment, second torsion rod 46 may be pre-deflected to compensate for the unequal weight distribution of cover 16. When cover 16 is in its open position (ninety degrees rotated from base 18), upper bent portion 98 may by deflected and secured in place with a rotated antirotation block 54. As cover 16 is rotated toward base 18, second torsion rod 46 will reach its free non-deflected position at a lower angle, such as when cover 16 is sixty (60) degrees from base 18. At this same position, first torsion rod 44 will be deflected due to the relative rotation of first upper mount 36 to second lower mount 42. In this way, first torsion rod 44 will counterbalance more weight from cover 16 in the sixty (60) degree position than will second torsion rod 46. This will prevent twisting of cover 16 due to unequal weight distribution.

In an another alternative embodiment, first and second torsion rods 44 and 46 may be adjustable to vary the first and second torsion forces for the particular configuration of hinge system 10. In the alternative embodiment, antirotation blocks 52 and 54 are rotatable relative to mounts 36 and 38, respectively. In this way, rotating blocks 52 and/or 54 relative to mounts 36 and 38, respectively, allows torsion rods 44 and 46 to be pre-loaded such that first and second torsion forces are adjustable to suit the user's preference in the particular application.

For example, block aperture 78 can be centrally located on first antirotation block 52. Loosening threaded fastener 51 allows the user to rotate antirotation block 52 relative to mount 36. Rotating antirotation block 52 also rotates slot 76, and thus rotates bent portion 92. In this way, first torsion rod 44 may be deflected, and thus pre-loaded, independent of the relative position of cover 16 to base 18. A combination of set screws could also be used to allow easier adjustment of block 54 relative to mount 36. Second antirotation block 54, threaded fastener 53, and second torsion rod 46 may function similarly.

In yet another alternative embodiment, hinge system 10 may include a hinged system 12 that comprises a door frame and a door hinged with hinge assembly 14. For example, an open-back truck often includes a removable top that has a horizontally hinged door. Hinge assembly 14 could be mounted to the top and to the door such that hinge assembly 14 controls the rotation of the door to the top in the same way it controls the rotation of cover 16 to base 18 in hinged structure 12. Upper mounts 36 and 38 are fixed to the top and lower mounts 40 and 42 are fixed to the door. Hinged assembly 14 will then hold the door steady in various angular positions of the door relative to the top.

Figure 7:
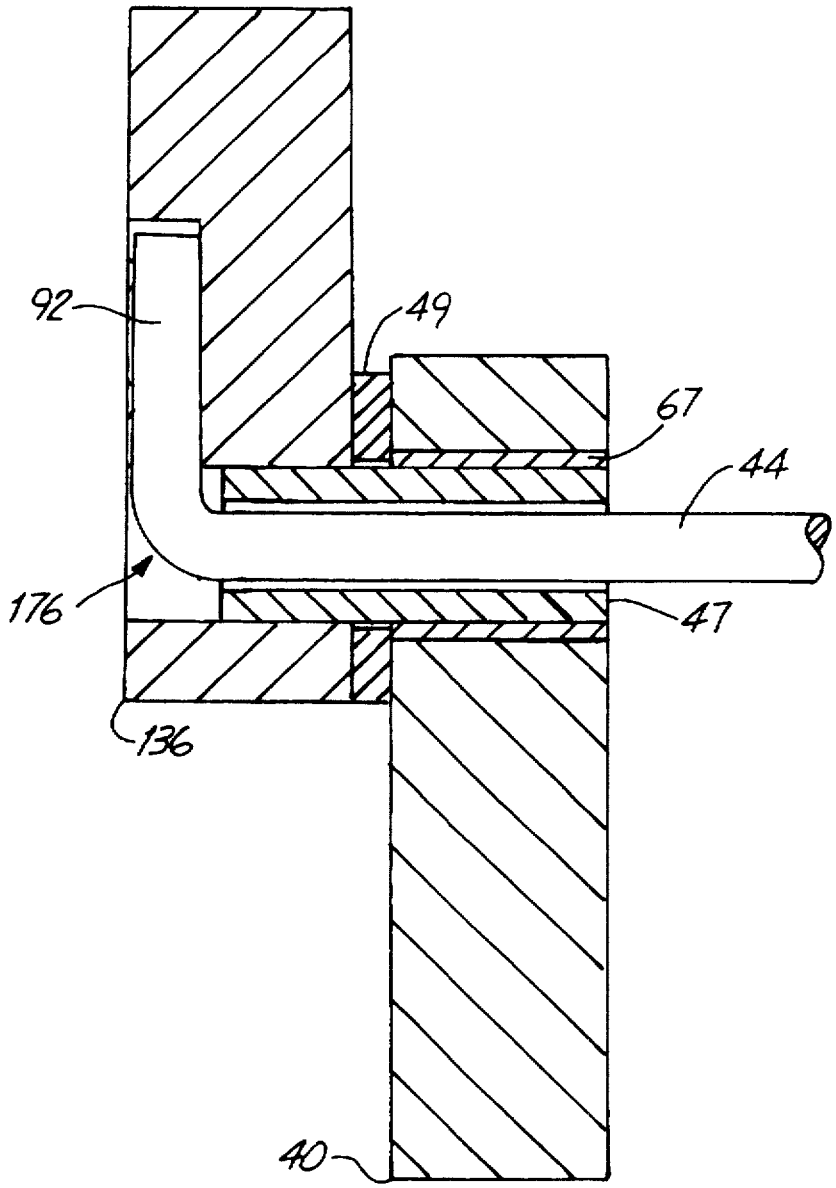
FIG. 7 is a sectional view of an alternative embodiment of a hinge assembly in accordance with the present invention.

It should be recognized that other means of fixing torsion rods 44 and 46 in hinge system 10 may be utilized to perform the present invention. For example, FIG. 7 shows a cross sectional view of an alternative embodiment fixing first torsion rod 44 with respect to hinge assembly 14. First bushing 67 is inserted in mount 40 and is frictionally locked therein. First spring pin 47 extends through bushing 67 (and through mount 40) and through upper mount 136. First torsion rod 44 extends through first spring pin 47. The diameter of rod 44 is less than the inner diameter of spring pin 47 such that there is no interference between rod 44 and spring pin 47.

Upper mount 136 includes slot 176 into which bent portion 92 of first torsion rod 44 staked. In this way, bent portion 92 of first torsion rod 44 is secured to upper mount 136 without the use of an antirotation block. Bent portion 98 of second torsion rod 46 can be similarly secured to upper mount 38. Other similar methods for securing the ends of first and second torsion rods to mounts 36, 38, 40, and 42 can be used to perform the present invention.

Although the present invention has been described with reference to preferred embodiments, workers skilled in the art will recognize that changes may be made in form and detail without departing from the spirit and scope of the invention.

What is claimed:

1. A hinge system for hingedly attaching a hinged element to a base, the hinged element and the base together forming a hinged unit, the hinge system comprising:

a first torsion rod having a first end fixedly positioned relative to the hinged element proximate a first location on the unit, and a second end fixedly positioned relative to the base proximate a second location on the unit, the first torsion rod configured to be deflected as the hinged element is rotated relative to the base producing a first torsion force;

a second torsion rod having a first end fixedly positioned relative to the base proximate the first location on the unit, and a second end fixedly positioned relative to the hinged element proximate the second location on the unit, the second torsion rod configured to be deflected as the hinged element is rotated relative to the base producing a second torsion force;

the first torsion rod and the second torsion rod being configured such that the first and second torsion forces prevent the hinged element from twisting as the hinged element is rotated relative to the base; and friction means connected between the base and the hinged element for offering resistance to the relative rotation of the base and the hinged element.

2. The hinged system of claim 1 further comprising:

first and second mounting blocks mounted to the hinged element proximate the first and second locations on the unit, respectively;

third and fourth mounting blocks mounted to the base proximate the first and second locations on the unit, respectively;

the first end of the first torsion rod being fixed to the first mounting block, the second end of the first torsion rod being fixed to the fourth mounting block, the first end of the second torsion rod being fixed to the third mounting block and the second end of the second torsion rod being fixed to the second mounting block.

3. The hinged system of claim 2 wherein the friction means is coupled between the first and third mounting blocks and between the second and fourth mounting blocks.

4. The hinged system of claim 3 wherein the first and second torsion rods pass through the friction means.

5. The hinged system of claim 2 wherein the friction means comprises a first spring pin frictionally coupled between the first and third mounting blocks and a second spring pin frictionally coupled between the second and fourth mounting blocks.

6. The hinged system of claim 5 wherein the first, second, third, and fourth mounting blocks define first, second, third, and fourth bores, respectively, wherein the first torsion rod passes through the first spring pin, the first spring pin being frictionally engaged in the first bore and in the third bore, and wherein the second torsion rod passes through the second spring pin, the second spring pin being frictionally engaged in the second bore and in the fourth bore.

7. The hinged system of claim 6 wherein a first bushing is disposed between the first spring pin and the third mounting block in the third bore and wherein a second bushing is disposed between the second spring pin and the fourth mounting block in the fourth bore.

8. The hinged system of claim 7 wherein the hinged unit comprises a barbecue grill, the hinged element comprises a cover for the barbecue grill, and the base comprises a body for the barbecue grill.

9. The hinged system of claim 7 wherein the hinged unit comprises a top for a truck, the hinged element comprises a door for the truck top, and the base comprises a body for the truck top.

10. The hinged system of claim 2 wherein the first end of the first torsion rod is fixed to the first mounting block with a first antirotation block, the second end of the first torsion rod is fixed to the fourth mounting block in a first slot formed in the fourth mounting block, the first end of the second torsion rod is fixed to the third mounting block with a second antirotation block, and the second end of the second torsion rod is fixed to the second mounting block in a second slot formed in the second mounting block.

11. The hinged system of claim 2 wherein the first end of the first torsion rod is adjustably fixed to the first mounting block with a first adjustable block, the second end of the first torsion rod is fixed to the fourth mounting block, the first end of the second torsion rod is adjustably fixed to the third mounting block with a second adjustable block, and the second end of the second torsion rod is fixed to the second mounting block.

12. The hinged system of claim 11 wherein the first and second mounting blocks are adjustable such that the first torsion force may be adjusted by adjusting the first mounting block and such that the second torsion force may be adjusted by adjusting the second antirotation block.

* * * * *

UNITED STATES PATENT AND TRADEMARK OFFICE

CERTIFICATE OF CORRECTION

PATENT NO. : 5,787,549

DATED : AUGUST 4, 1998

INVENTOR(S) : JEFFREY A. SODERLUND

It is certified that error appears in the above-identified patent and that said Letters Patent is hereby corrected as shown below:

Col. 2, line 11, delete "defme", insert --define--

Col. 2, line 27, delete "th", insert --the--

Col. 2, line 29, delete "th" and insert --the--

Signed and Sealed this

Ninth Day of November, 1999

*Attest:*

*Attesting Officer*

Q. TODD DICKINSON

*Acting Commissioner of Patents and Trademarks*